United States Patent [19]

Kolibas

[11] Patent Number: 4,615,296

[45] Date of Patent: Oct. 7, 1986

[54] CONTINUOUS COATING SYSTEM FOR DISCRETE ARTICLES

[75] Inventor: James A. Kolibas, Broadview Heights, Ohio

[73] Assignee: Nordson Corporation, Amherst, Ohio

[21] Appl. No.: 640,944

[22] Filed: Aug. 15, 1984

[51] Int. Cl.[4] ..... B05B 7/06

[52] U.S. Cl. ..... 118/314; 118/317; 118/324

[58] Field of Search ..... 118/314, 317, 324

[56] References Cited

U.S. PATENT DOCUMENTS

| | | | |
|---|---|---|---|
| 665,088 | 1/1901 | Gould, Jr. | 228/43 X |
| 958,741 | 5/1910 | Graham | 228/43 X |
| 2,166,598 | 7/1939 | Kornquest | 113/60 |
| 2,220,107 | 11/1940 | Holloway | 113/7 |
| 2,296,201 | 9/1942 | Carter | 198/579 |
| 2,322,221 | 6/1943 | Cereghino | 113/97 |
| 2,798,456 | 7/1957 | Pearson | 118/317 |
| 2,895,449 | 7/1959 | Oldfield, Jr. | 118/306 |
| 2,996,040 | 8/1961 | Bofinger | 118/301 |
| 3,000,338 | 9/1961 | Sillars | 113/60 |
| 3,190,528 | 6/1965 | Sillars | 228/43 |
| 3,230,927 | 1/1966 | Brichta, Jr. et al. | 118/317 |
| 3,269,297 | 8/1966 | Hilgeland | 198/579 |
| 3,371,837 | 3/1968 | Sillars | 228/43 |
| 3,371,838 | 3/1968 | Sillars | 228/43 |
| 3,384,286 | 5/1968 | Sillars | 228/11 |
| 3,394,450 | 7/1968 | Gill et al. | 29/430 |
| 3,404,658 | 10/1968 | French et al. | 198/577 |
| 3,485,339 | 12/1969 | Miller et al. | 198/577 |
| 3,526,027 | 9/1970 | Manuel et al. | 29/200 |
| 3,565,318 | 2/1971 | Sillars | 228/37 |
| 3,697,313 | 10/1972 | Stumphauzer et al. | 118/318 |
| 3,702,107 | 11/1972 | Rood et al. | 118/2 |
| 3,726,711 | 4/1973 | Hogstrom | 118/318 |
| 3,756,489 | 9/1973 | Chartet | 228/43 |
| 3,778,292 | 12/1973 | Rood et al. | 118/2 |
| 3,816,165 | 6/1974 | Horvath et al. | 118/301 |
| 3,827,545 | 8/1974 | Buhayar | 198/34 |
| 3,921,570 | 11/1975 | Hogstrom et al. | 118/2 |
| 3,952,698 | 4/1976 | Beyer et al. | 118/314 |
| 3,995,075 | 11/1976 | Cernauskas et al. | 427/236 |
| 4,051,805 | 10/1977 | Waldrum | 118/314 X |
| 4,072,127 | 2/1978 | Cernauskas et al. | 118/2 |
| 4,093,113 | 6/1978 | Sillars | 228/36 |
| 4,098,226 | 7/1978 | Furter | 118/622 |
| 4,147,288 | 4/1979 | Sillars | 228/43 |
| 4,180,011 | 12/1979 | Halicki | 118/685 |
| 4,197,976 | 4/1980 | Sillars | 228/43 |
| 4,202,483 | 5/1980 | Sillars | 228/43 |
| 4,215,648 | 8/1980 | Stamets et al. | 118/622 |
| 4,249,476 | 2/1981 | Opprecht et al. | 118/204 |
| 4,337,281 | 6/1982 | Boone | 427/239 |
| 4,353,326 | 10/1982 | Kolibas | 118/696 |
| 4,360,098 | 11/1982 | Nordstrom | 198/419 |
| 4,378,386 | 3/1983 | Rehman | 427/233 |
| 4,414,248 | 11/1983 | Kolibas | 427/236 |

*Primary Examiner*—Thurman K. Page

*Attorney, Agent, or Firm*—Wood, Herron & Evans

[57] ABSTRACT

Spaced apart, hollow, can bodies are formed around a stubhorn and moved past a spray nozzle for spray coating the inside seams of the can bodies. Each can body is received from a conveyor and moved past the spray nozzle at a sufficiently reduced speed to allow the succeeding can body to move into contact with the preceding can body. The spray nozzle continuously sprays the seams of the can bodies, which form in effect a continuous "tube" of can bodies moving past the nozzle. Each can body is conveyed away from the coating station at a speed preferably corresponding to the input conveyor speed so that the spacing between the can bodies is restored. Conveying apparatus at the coating station is provided with a one-way clutch to accommodate conveyor overrunning when uncoated cans are received and when coated cans are drawn away.

5 Claims, 2 Drawing Figures

CONTINUOUS COATING SYSTEM FOR DISCRETE ARTICLES

DESCRIPTION OF THE INVENTION

This invention relates generally to systems for coating articles with a coating material, and more particularly to the application of a protective coating to the interior seams of can bodies as the can bodies move past a spray coating nozzle.

In the manufacture of hollow articles such as cans, the cylindrical bodies of the cans are typically formed by wrapping sheets of metal around a so-called stubhorn, or mandrel. The ends of each sheet are either butted or overlapped and secured together by either a welded seam, a soldered seam, or a cemented seam as each can body moves longitudinally down the stubhorn. These formed can bodies are serially conveyed at a predetermined speed down the stubhorn with a small space between each consecutive can body.

It is generally the practice in the can industry to apply a coating material, such as vinyl lacquer, onto the inside of the cans. This prevents the metallic can bodies from contaminating the subsequent contents of the can and also prevents leakage. Frequently, the entire inside surface of the can is coated. Alternatively, or additionally, a different coating is applied to only the can seam. This seam coating is frequently applied as the can bodies move off the stubhorn and past a spray apparatus. Such apparatus is attached to the end of the stubhorn internally of the cans.

In the past, the spray apparatus has included an on/-off spray nozzle which is operated intermittently so that the coating material is sprayed only when a can body is above the spray nozzle, and not while there is a space between consecutive can bodies above the nozzle. This prevents excess coating material from being wasted, prevents environmental contamination, and also limits the potential for contamination of the machinery associated with the coating apparatus.

Spray nozzle and valve devices for producing suitable on/off operation are relatively expensive. In a high speed can body seam coating system, the valve cycle rate is high. For example, it is not uncommon for can forming machines to produce as many as 400 cans per minute. In an exemplary system, at a production rate of 400 cans per minute, the coating apparatus must be on for about 140 milliseconds and off for about ten milliseconds to perform the can body seam coating operation. As the can body forming speed increases, the coating apparatus and coating valve control system must function at even higher speeds, and they become even more complex and expensive.

One prior means of dealing with these high rates of can production has been to utilize two spray nozzles. Such apparatus is shown in U.S. Pat. No. 4,414,248. In such a system, the nozzles are activated alternately so that a given nozzle only coats every other can body. Each nozzle is thus only operated at one-half the frequency otherwise required for a single nozzle operation. While this approach has worked well, it does entail the use of an additional spray nozzle as well as two valves and associated valve control circuitry.

Accordingly, it has been one objective of the invention to provide an improved can coating apparatus.

A further objective of the present invention has been to provide a coating apparatus in which articles moving therepast can be internally coated with reduced environmental contamination or waste and which apparatus may be operated at high speeds without additional coating nozzles or coating control apparatus.

To these ends, a can coating apparatus according to a preferred embodiment of the invention includes means for reducing the speed of each can at a coating station from the speed at which it is conveyed to the station so that each succeeding can contacts the preceding one. The now-adjacent articles are conveyed past the coating apparatus, which operates continuously. The spray nozzle of the coating apparatus sees, in effect, only a continuous "tube" of abutted cans. There is thus no reason to cycle the nozzle on and off and it is operated continuously. This continuous operation greatly reduces waste and environmental contamination even though operating continuously, since no coating material is sprayed through spaces between cans. Also, it is unnecessary to use multiple or expensive valves.

In the preferred embodiment of the invention, after each can body passes the spray nozzle, it is accelerated to another speed which may be the same speed as that at which it was conveyed to the coating station. The spaces between the can bodies are thus restored after the spray coating operation.

Further objects and advantages of the invention, and the manner of their implementation, will become apparent upon reading the following detailed description and upon reference to the drawings, in which:

Figures 1, 2:
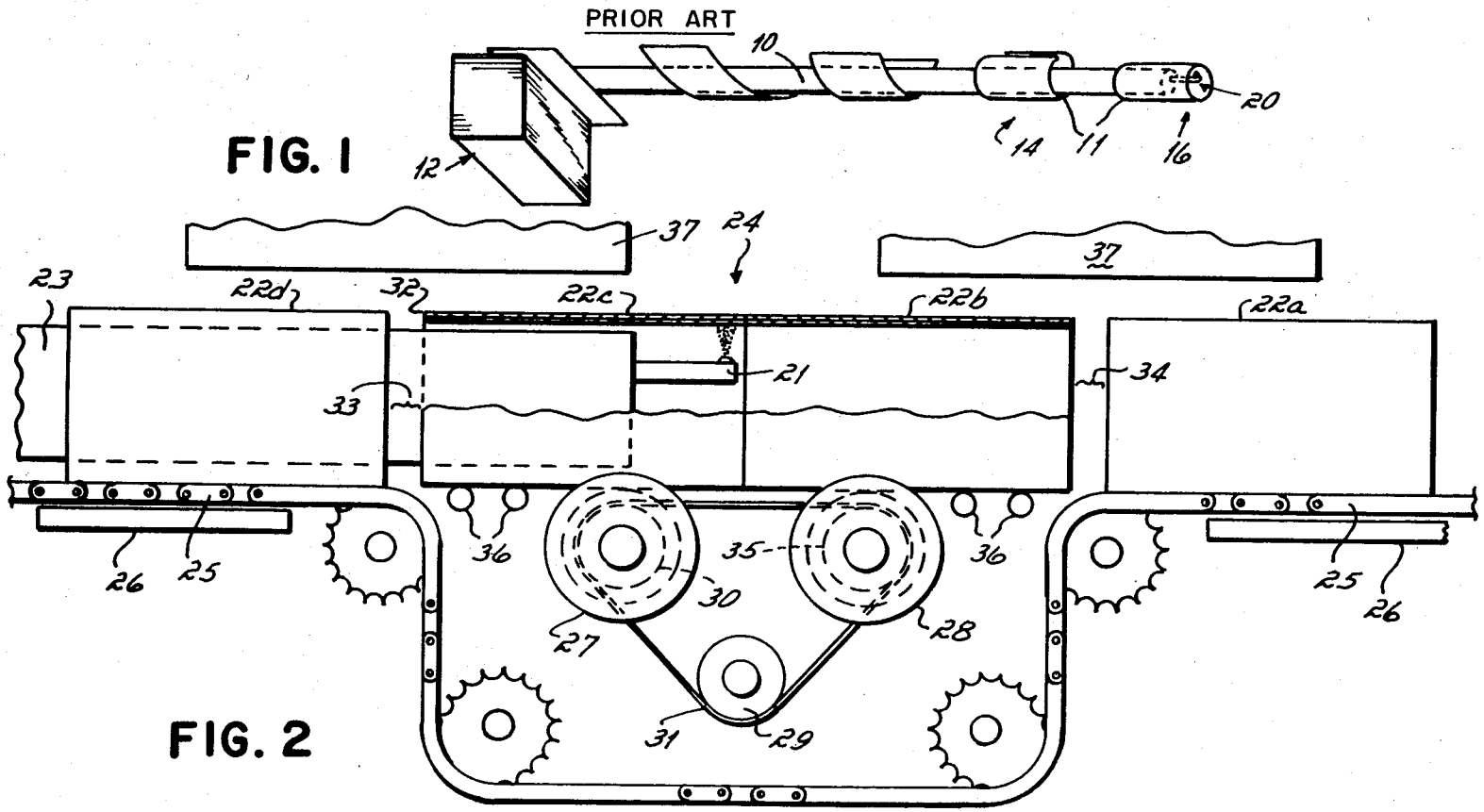
FIG. 1 is a diagrammatic illustration of a typical prior art can body forming line.
FIG. 2 is a diagrammatic illustration of a can body inside seam coating apparatus in accordance with the present invention.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

A preferred embodiment of the present invention constitutes a can body inside seam coating apparatus. To serve as an aid in understanding this form of the invention, a typical prior art can body forming apparatus shall first be briefly described.

Referring to FIG. 1, a typical can body production line includes a stubhorn 10 which serves as a mandrel around which can bodies 11 are formed as they pass downstream. The can bodies 11 are conveyed longitudinally over the stubhorn from a magazine 12. As the cylindrical can bodies pass off of the stubhorn, they move further downstream for the continued formation of cans from the can bodies.

In the final stages of movement of the can bodies over the stubhorn 10, the ends of the sheet metal from which each can body is made are overlapped or joined at a seaming station indicated generally at 14. Such joining may provide overlap or abutted joints which are adhesively fixed, welded or otherwise secured. As the can bodies pass off of the stubhorn 10, they move through an inside seam coating station 16 at which a stripe of protective coating material is sprayed over the seam on the inside of the can. The striping is accomplished by a spray nozzle 20 secured to the end of the stubhorn 10.

In the typical prior art system, the spray nozzle is suitably controlled to spray the coating material only when a can is positioned over the nozzle. Consequently, the spray nozzle is typically turned on as a can body passes, and turned off during the interval from the departure of a can body from the spray nozzle to the arrival of the next can body at the spray nozzle.

With reference now to FIG. 2, a can body inside seam coating apparatus in accordance with the present invention includes a spray coating nozzle 21 for coating the inside seams of can bodies 22*a*–22*d* conveyed along a stubhorn, or mandrel, 23 of a can body forming apparatus such as that of FIG. 1. The can bodies are conveyed toward a coating station 24, in the vicinity of the spray nozzle 21, by a conveyor 25. The can bodies 22*a*–22*d* are held in engagement with the conveyor 25 by a series of permanent magnets, such as at 26, positioned below the conveyor. These magnets control the can orientation to insure that the can seams are located directly above the spray nozzle. The conveyor 25 may take a number of forms, such as a pair of conveyor chains positioned side by side beneath the can bodies.

In accordance with the invention, adjacent can bodies, such as 22*b* and 22*c*, are positioned abutting one another as the trailing end of the can body 22*b* and the leading end of the can body 22*c* move past the spray nozzle 21. In this way, the spray nozzle 21 may operate continuously, effectively operating within a continuous "tube" of can bodies.

In order to accomplish this abutting can body relationship at the spray coating station, each can body is received from the conveyor 25, at the coating station 24, by a pair of reduced speed drive wheels 27, 28. The wheels 27, 28 are driven by a reduced speed drive 29 via a drive belt 31. After passing through the coating station 24, the cans 22 are preferably returned onto the conveyor 25 and are moved away from the coating station at the higher speed of the conveyor 25. Alternatively, another conveyor operating at the same or other speed than that of conveyor 25 could be used to draw cans away from coating station 24. Therefore, a spacing between the can bodies (which may be the same spacing as that previously between the can bodies) is restored as the can bodies move downstream from the coating station.

Considering the structure and operation of the reduced speed drive at the coating station in more detail, as each can leaves the line speed conveyor 25, the can body contacts the drive wheel 27. The drive wheel 27 is fitted with a one-way overrunning clutch 30, so that when the can body is in engagement with both the conveyor 25 and the wheel 27, the wheel 27 is free to rotate more rapidly than it is driven by the reduced speed drive 29. Once the trailing end of the can body, such as the end 32 of the can body 22*c*, leaves the conveyor 25, the can body is driven at the reduced speed of the wheel 27. This allows the subsequent can body, driven at the higher speed of the conveyor 25, to close the space between consecutive can bodies, such as the gap 33 between the can bodies 22*c* and 22*d*. As the now-abutting can bodies, such as the can bodies 22*b* and 22*c*, move past the spray gun 21, they are advanced by the reduced speed drive wheels 27, 28 at a speed less than that of the speed of conveyor 25 until the spray gun has sprayed the butted seams of the two can bodies.

Subsequently, the leading can body, such as the can body 22*b*, once again comes into contact with the line speed conveyor 25, increasing the can body's speed of travel. The can body, such as the can body 22*a*, is advanced away from the following can body, such as the can body 22*b*, restoring the original spacing gap 33 between the can bodies, and shown as the gap 34. As the leading can body exits the coating station 24, the wheel 28, which is driven through a one-way overrunning clutch 35, free-wheels, allowing the can body to depart at the higher speed of the line conveyor 25.

In its preferred form, the reduced speed drive 29 for the wheels 27, 28 is adjustable so that a suitable speed may be selected, relative to the speed of the conveyor 25, to accommodate various spacing or gaps between can bodies. In the illustrated form of the drive wheels 27, 28, each drive wheel comprises a pair of shaped rollers presenting a continuous supporting groove to the can bodies passing over the drive wheel. Guide rollers 36 may also be provided under the can bodies in the coating station to further support the can bodies as they move through the coating station. Alternatively, rails (not shown) may be oriented axially with respect to the cans to cradle them as they are transferred from the conveyor 25 to wheels 27, 28 and then again to the conveyor 25. An exhaust system 37 exhausts coating material fumes, such as solvent fumes, from the vicinity of the coating station.

While only a single preferred embodiment of the present invention has been described herein, numerous changes and modifications may be made without departing from the spirit of the invention. For example, in the illustrated form of the invention, the reduced speed drive wheel arrangement serves as the drive for moving the can bodies past the spray nozzle 21. Alternative drive means for moving the can bodies past the spray nozzle at other speeds may be provided, once the can body speed has first been reduced so that consecutive can bodies move into contact with one another. Moreover, other hollow articles than can bodies and such as packages could be so coated.

Accordingly, applicant intends to be limited only by the claims appended hereto.

What is claimed is:

1. Apparatus for coating articles in a series of conveyed articles at a coating station, comprising:

first conveying means for conveying at a first speed, a series of articles, spaced apart from one another in end-to-end relationship to a coating station, and diverging from said articles at said coating station;

coating means for coating at least a portion of each article as it is moved past the coating means;

means at the coating station for receiving each article from the first conveying means, for abutting adjacent articles together, and for moving the received articles in abutting relationship past the coating means at a reduced speed; and said first conveying means converging with said articles downstream of said coating station, separating said articles and conveying said separated articles away from said coating station at a speed equal to said first speed.

2. The apparatus of claim 1 in which the means for reducing the speed of each article and for moving the received articles past the coating means moves the received articles past the coating means at a reduced speed less than said first speed.

3. The apparatus of claim 2 wherein said means for receiving articles, and for moving articles in abutting relationship past the coating means at a reduced speed comprises conveying apparatus having article engaging driven members including one-way overrun clutch means permitting overrunning of said driven members at a conveying speed faster than said reduced speed upon receipt of an article at the coating station and upon exit of a coated article from the coating station.

4. Apparatus for coating inside portions of hollow articles in a series of spaced conveyed hollow articles, said apparatus comprising:

a coating station;

first conveying means for conveying a series of hollow articles, spaced apart from one another, to and from a coating station at a first speed;

coating means, substantially continuously operated at the coating station, for coating at least an inside portion of each hollow article as it is moved past the coating means;

means at the coating station for receiving each hollow article from the first conveying means and for moving each received hollow article past the coating means at a reduced speed relative to said first speed such that each received hollow article is contacted by an end of the following hollow article at the coating station to eliminate the spacing between said articles and thereby form a continuous inside surface for coating; and wherein said first conveying means conveys the coated hollow articles from the coating station at said first speed so that a spacing between the hollow articles is restored.

5. Apparatus for coating the inside seams of can bodies conveyed in a series of spaced can bodies, said apparatus comprising:

a coating station;

first conveying means for conveying a series of spaced apart can bodies along a mandrel to said coating station and away from said coating station, in spaced relationship, after said coating at a first speed;

spray nozzle means mounted on the end of the mandrel for continuously dispensing coating material;

means at the coating station for receiving each can body from the first conveying means, for reducing the speed of each received can body to a speed sufficiently slower than that of the following can bodies conveyed on said first conveying means such that an end of each received can body is contacted by an end of the following can body at the coating station to eliminate the spacing therebetween, and for moving the received can bodies in end-to-end contact with one another past the spray nozzle so that the now-adjacent can bodies form a continuous "tube" moving past the spray nozzle; and wherein said can body receiving and speed reducing means comprises can body engaging, driven rollers having one-way overrunning clutch means permitting overrunning of said driven members at a speed approximate that of said first speed upon receipt of a can body at the coating station and upon exit of a coated can body from the coating station.

* * * * *